US006871371B2

(12) United States Patent
Guest

(10) Patent No.: US 6,871,371 B2
(45) Date of Patent: Mar. 29, 2005

(54) FLOOR CARE MACHINE WITH REPLACEABLE FLOOR CARE ELEMENT

(75) Inventor: Michael Guest, Morrison, CO (US)

(73) Assignee: Castle Rock Industries, Inc, Englewood, CO (US)

( * ) Notice: Subject to any disclaimer, the term of this patent is extended or adjusted under 35 U.S.C. 154(b) by 291 days.

(21) Appl. No.: 10/124,682

(22) Filed: Apr. 16, 2002

(65) Prior Publication Data

US 2003/0192140 A1 Oct. 16, 2003

(51) Int. Cl.[7] ..... A47L 11/283

(52) U.S. Cl. ..... 15/49.1; 15/50.1; 15/98; 451/353

(58) Field of Search ..... 15/49.1, 50.1, 15/98, 320; 451/353

(56) References Cited

U.S. PATENT DOCUMENTS

| | | | | |
|---|---|---|---|---|
| 1,670,302 A | | 5/1928 | Finnell | |
| 3,264,674 A | | 8/1966 | Doyle, Jr. | |
| 3,600,735 A | | 8/1971 | Jerabek | 15/49 |
| 4,059,930 A | | 11/1977 | Alessio | 51/268 |
| 4,322,920 A | | 4/1982 | Wells | 51/168 |
| 4,662,024 A | | 5/1987 | Moench | 15/230.19 |
| 4,866,804 A | | 9/1989 | Masbruch et al. | 15/49 |
| 5,054,245 A | | 10/1991 | Coty | 51/170 |
| 5,347,673 A | | 9/1994 | Nickels, Jr. | 15/97.1 |
| 5,421,053 A | | 6/1995 | Chodak | 15/87 |
| 5,439,413 A | | 8/1995 | Lagler | 451/353 |
| 5,619,770 A | | 4/1997 | Bell | 15/230.17 |
| 5,645,365 A | | 7/1997 | Malish et al. | 403/348 |
| 5,806,132 A | | 9/1998 | Kelley | 15/230.17 |
| 6,651,286 B2 | * | 11/2003 | Pierce | 15/98 |
| 2003/0115697 A1 | * | 6/2003 | Deiterman | 15/49.1 |
| 2004/0045108 A1 | * | 3/2004 | Fellhauer | 15/49.1 |

* cited by examiner

*Primary Examiner*—Robert J. Warden, Sr.
*Assistant Examiner*—S Balsis
(74) *Attorney, Agent, or Firm*—Sheridan Ross P.C.

(57) ABSTRACT

A floor care method and machine are disclosed, wherein a replaceable floor care element (e.g., a cleaning pad, a brush, a polishing pad, etc.) is easily attached to and detached from the rest of the machine. For attaching the floor care element, an operator positions the machine (minus any floor care element) over the such an element so that components on the machine and/or the floor care element cause the floor care element to operationally align with the rotatable drive of the machine so that rotation of the drive in the direction used during floor care operations causes the floor care element to securely attach to the drive. Alternatively, to detach the floor care element, the direction of rotation can be reversed. The machine can then be tilted upwardly onto its rotatable wheels and rolled to a location where the floor care element is not underneath the rest of the machine.

17 Claims, 7 Drawing Sheets

FLOOR CARE MACHINE WITH REPLACEABLE FLOOR CARE ELEMENT

FIELD OF THE INVENTION

The present invention relates to a floor care machine wherein the element which contacts the floor and processes it (e.g., cleans, polishes, etc.) is easily attachable and detachable.

BACKGROUND OF THE INVENTION

Machines that perform floor care operations such as cleaning, polishing, sweeping, scrubbing, etc. typically include a replaceable floor care element that contacts the floor and performs the desired floor care operations. In particular, such an element may be disk-shaped wherein the circular area of one side of the element rotates about its center during floor care operations. However, to initially attach such a floor care element and/or replace an attached element with another such element has heretofore been time consuming and difficult. Accordingly, it is desirable to have a floor care machine and compatible floor care elements wherein such elements can be easily attached and detached from the floor care machine.

SUMMARY OF THE INVENTION

The present invention is a floor machine or floor care machine and method of use wherein a replaceable floor care element is easily attached and/or detached from the floor care machine. More particularly, the floor care element may be attached to the floor care machine by:

(a) placing the floor care element on the floor, positioning the floor care machine adjacent thereto (e.g., so that the floor care element is immediately in front of the machine), (b) tilting the machine so that it pivots upwardly on its rear wheels, moving the machine so that the floor care element is underneath the machine, (c) aligning the floor care element with the drive assembly of the machine by moving the machine (e.g., front while it is tilted upwardly) so that the floor care element contacts and is coarsely positioned for attachment by an aligning member connected to the underside of the machine, (d) allowing the machine pivot downwardly whereby additional aligning components (e.g., mating chamfers) on each of the drive assembly and the upward facing portion of the floor care element finely align a lower portion of drive assembly with the floor care element so that mating takes place, and (e) operating the motor of the machine so that the rotation of the lower drive assembly causes the floor care element and the lower drive assembly to be secured together for subsequently processing the floor. In particular, the floor care element and the lower drive assembly are secured together by additional mating features of the floor care element and the lower drive assembly when the motor rotates the lower drive assembly in the same rotational direction that the motor rotates the lower drive assembly when floor care operations are being performed on the floor.

In one embodiment of the present invention, the lower drive assembly and floor care element are secured by the insertion of each of one or more attachment pieces, on one of the lower drive assembly and floor care element, into a corresponding slot on the other of the assembly and the floor care element. In particular, each slot may have an expanded first end and a more narrow second end so that once the attachment piece enters the expanded end and then rotates toward the narrow end, an enlarged head of the attachment piece is not able to fit through the slot and thus the floor care element is secured to the lower drive assembly for as long as the attachment pieces remain in the narrow portion of their respective slots. In particular, since the direction of rotation of the floor care element during floor care operations urges the attachment pieces to remain in the narrow ends of their respective slots, the floor care element remains securely attached to the machine during floor operations. However, for releasing or detaching the floor care element from the lower drive assembly, an operator of the machine can reverse the rotational direction of the motor so that the slots move relative to their attachment pieces and the attachment pieces are positioned at the expanded end of their corresponding slot. Accordingly each attachment piece may easily disengage from its slot when the operator pivots the machine upwardly onto its rear wheels. Subsequently, all the operator needs to do is roll the machine on its rear wheels until the now detached floor care element is no longer underneath the machine.

Other benefits and features of the present invention will become evident from the accompanying drawing and Detailed Description hereinbelow. In particular, various other alternative embodiments, in additional to the embodiment(s) described above are described in the Detailed Description, and these alternative embodiments are to be considered within the scope of the present invention.

DETAILED DESCRIPTION

Figure 1:
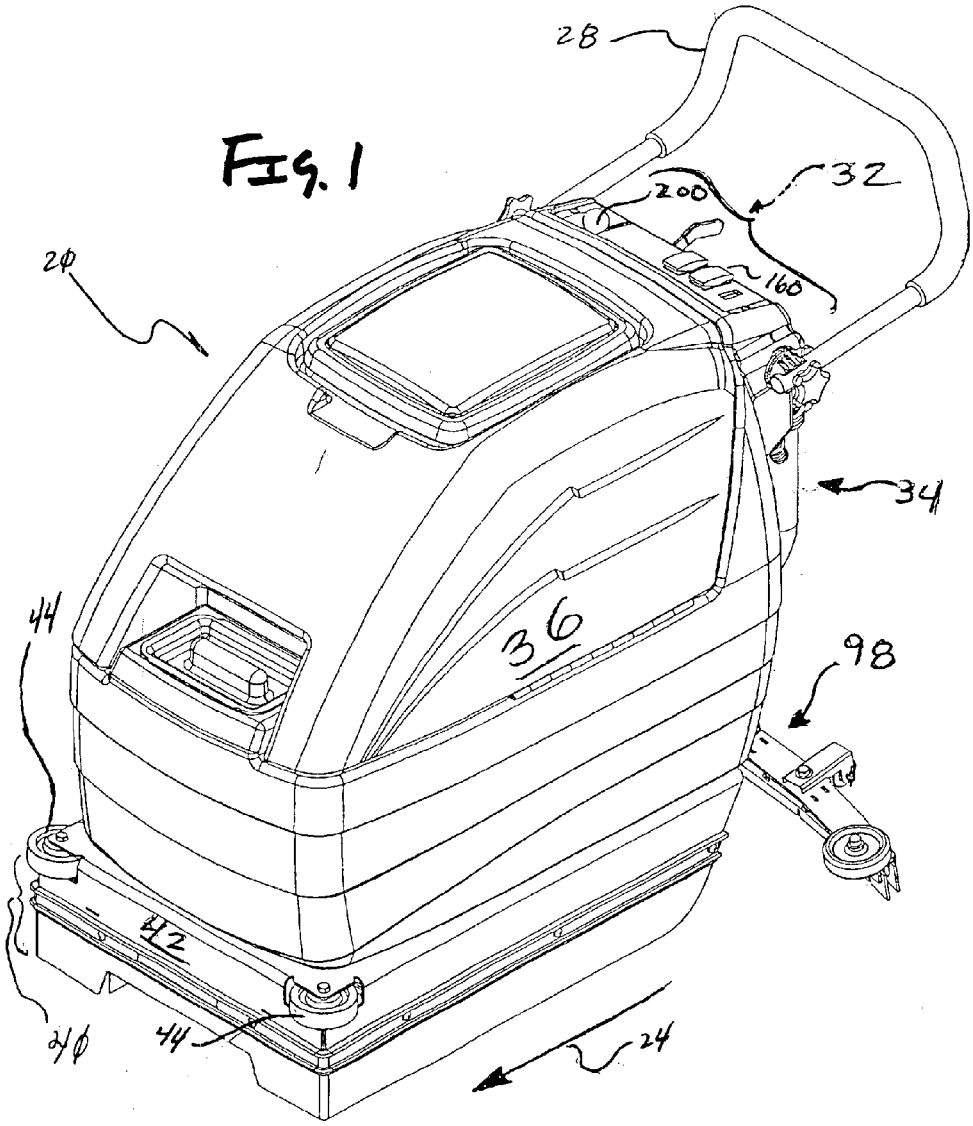
FIG. 1 is an exterior oblique view of a floor care machine 20 according to the present invention.

FIG. 1 shows an exterior view of a floor machine 20 according to the present invention. In particular, the machine

20 may be, e.g., a floor cleaning machine, a floor polishing machine, a floor scrubbing machine, floor sweeping or brush machine, a floor wax removal machine, or a floor sanding or scoring machine. When performing floor care operations (e.g., cleaning, scrubbing, polishing, sanding, etc.) on a floor surface, the machine 20 generally moves in the direction of arrow 24 with an operator (not shown) walking behind and guiding the machine 20 via the handle 28 and operating the machine via the machine controls generally located in the upper rear 32 of the main body 34 of the machine 20, the controls being described hereinbelow. In particular, the main body 34 includes an upper housing 36 and a lower skirting 40, wherein the lower skirting has (in the present embodiment) a generally rectangular footprint on the floor, wherein at least the front 42 of the skirting includes wheel bumpers 44 that allow the machine 20 to, e.g., scrub, clean, sweep or polish a floor adjacent to, e.g., a wall or a pillar, wherein at least one of the wheel bumpers may roll intermittently along the vertical surface of the wall or pillar. The lower skirting 40 surrounds and is attached to a frame 46 (FIGS. 2, 3 and particularly 8), and the frame 46 serves as a support and is joined to the upper housing 36 as well. The front wheels 48 and the rear wheels 50 (FIG. 2) upon which the cleaning machine 20 rolls are also attached to the frame 46. Additionally, within the lower skirting 40 is a replaceable floor care element 52 (FIGS. 2, 3), wherein this element contacts and processes the floor (e.g., a surface thereof) within the footprint of the lower shirting 40 when the machine 20 is operably scrubbing. In particular, the care element 52 is generally disk-shaped having on one side a floor contacting portion 56 (such as a brush, a pad, a scrubber, a sweeper, a polishing disk, sanding disk, etc.) for processing the floor with its floor contacting side 60, and on the opposite side, the element has an attachment assembly 64 which serves as both an attachment for the floor contacting portion 56, and as an attachment to the machine 20. In particular, the attachment assembly 64 includes one or more attaching members 66 for attaching the care element 52 to the machine 20 in a manner described further hereinbelow. The attaching members 66 may be of substantially any type known in the art that can releasably mate with a compatible counterpart. For example, such a member 66 may include an attachment piece 68 having, e.g., a recess 70 and expanded head 71, wherein there may be an appropriately configured slot within which the attaching member can mate for securing the care element 52 to the machine 20. However, other types of attaching members 66 (and their mating counterparts as described hereinbelow) are also within the scope of the invention, such as latches, threaded pieces, or hooked pieces. Further note that the attaching members 66 are radially uniformly spaced from the axis 72 (FIG. 3) which coincides with a central axis 73 (FIGS. 4 and 8) about which the care element 52 rotates when the machine 20 is performing floor care operations on the floor. Moreover, it should also be noted that during floor care operations, the floor care element 52 of the embodiment illustrated in the FIGS. 1–8 rotates about coincident axes 72 and 73 in only one direction such as is indicated by arrow 74 (FIG. 3).

Above and operably joined to the floor care element 52 and within the upper housing 36 is a drive assembly 76 (FIGS. 4 and 8) including an upper drive assembly 78*a* and a lower drive assembly 78*b*. The upper drive assembly 78*a* includes a motor 82 for rotating the floor care element 52 during floor care operations, and a motor mount subassembly 86 by which the motor is operably attached to the frame 46 in a manner that allows the motor to move vertically along central axis 72 in relation to the frame.

In embodiments of the invention wherein a solution is applied to the floor, such as cleaning, polishing or waxing solution, the frame 46 also supports containers for such solutions. In the embodiment of the FIGS. 1–8, solution containers 90 and 94 (FIG. 4) are provided substantially within the upper housing 36. For embodiments of the machine 20 which clean floors such solution containers 90 and 94 may be used for holding both unused cleaning solution, and used cleaning solution reclaimed from being deposited on the floor by, e.g., a solution sprayer (not shown). Additionally, for floor cleaning embodiments of the machine 20, there may be a squeegee assembly 98 (e.g., FIGS. 1 and 5) which collects and/or vacuums up excess floor care or cleaning solution that remains from the floor cleaning process.

Figure 2:
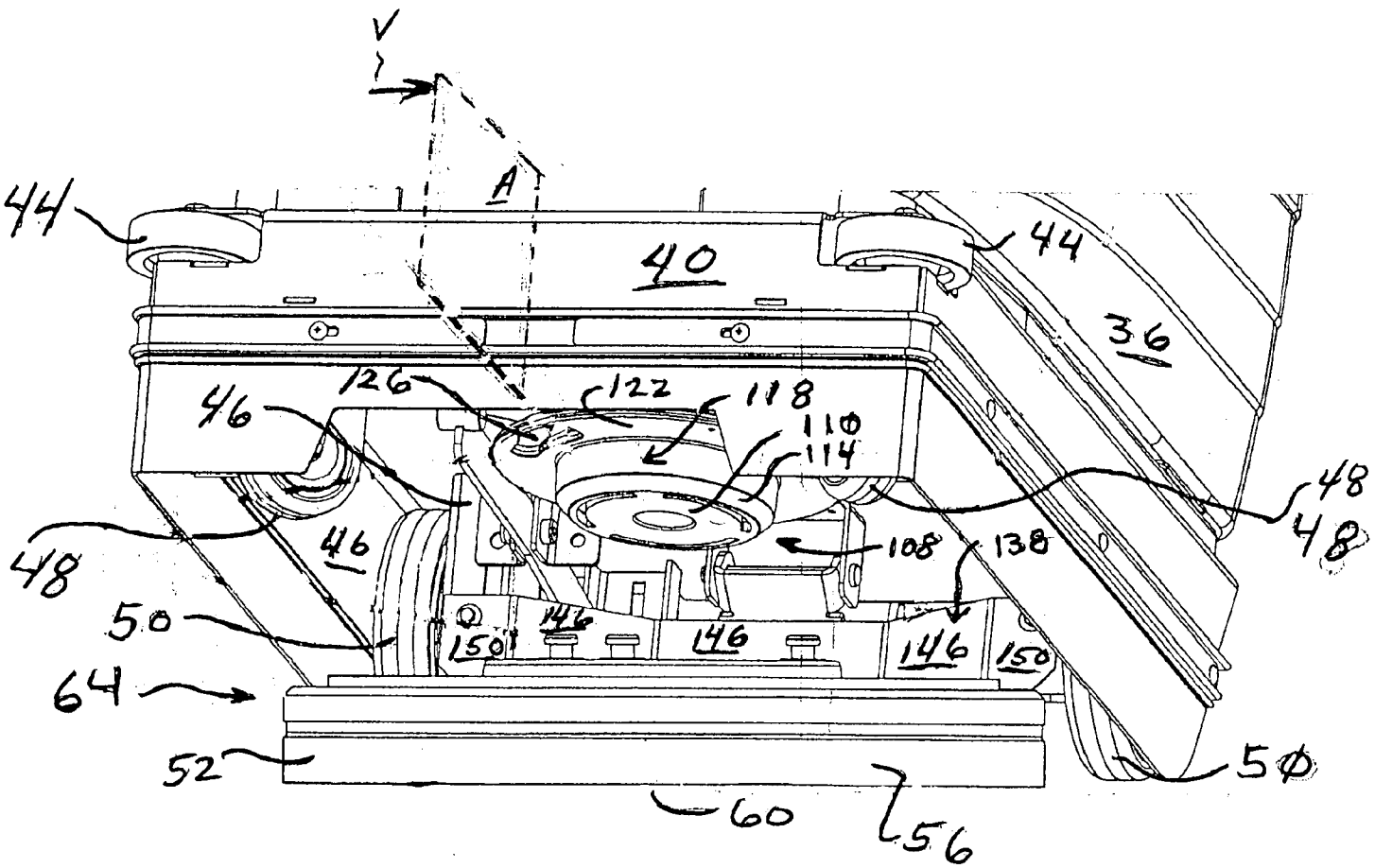
FIG. 2 shows the interior components of the floor care machine 20 as viewed when the floor processing machine is tilted upwardly on its rear wheels 50.
Figure 3:
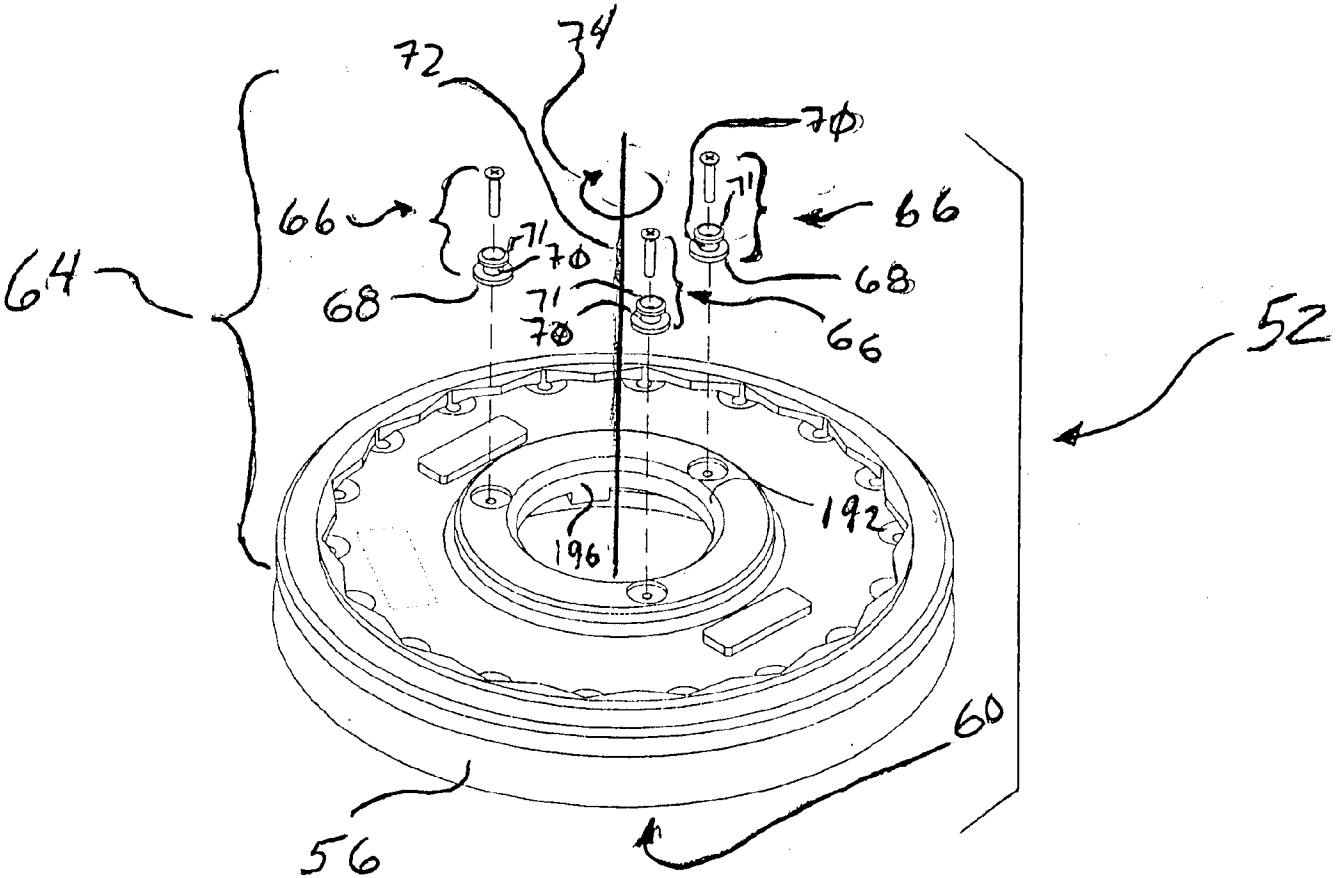
FIG. 3 shows a partially exploded view of the floor care element 52.
Figure 4:
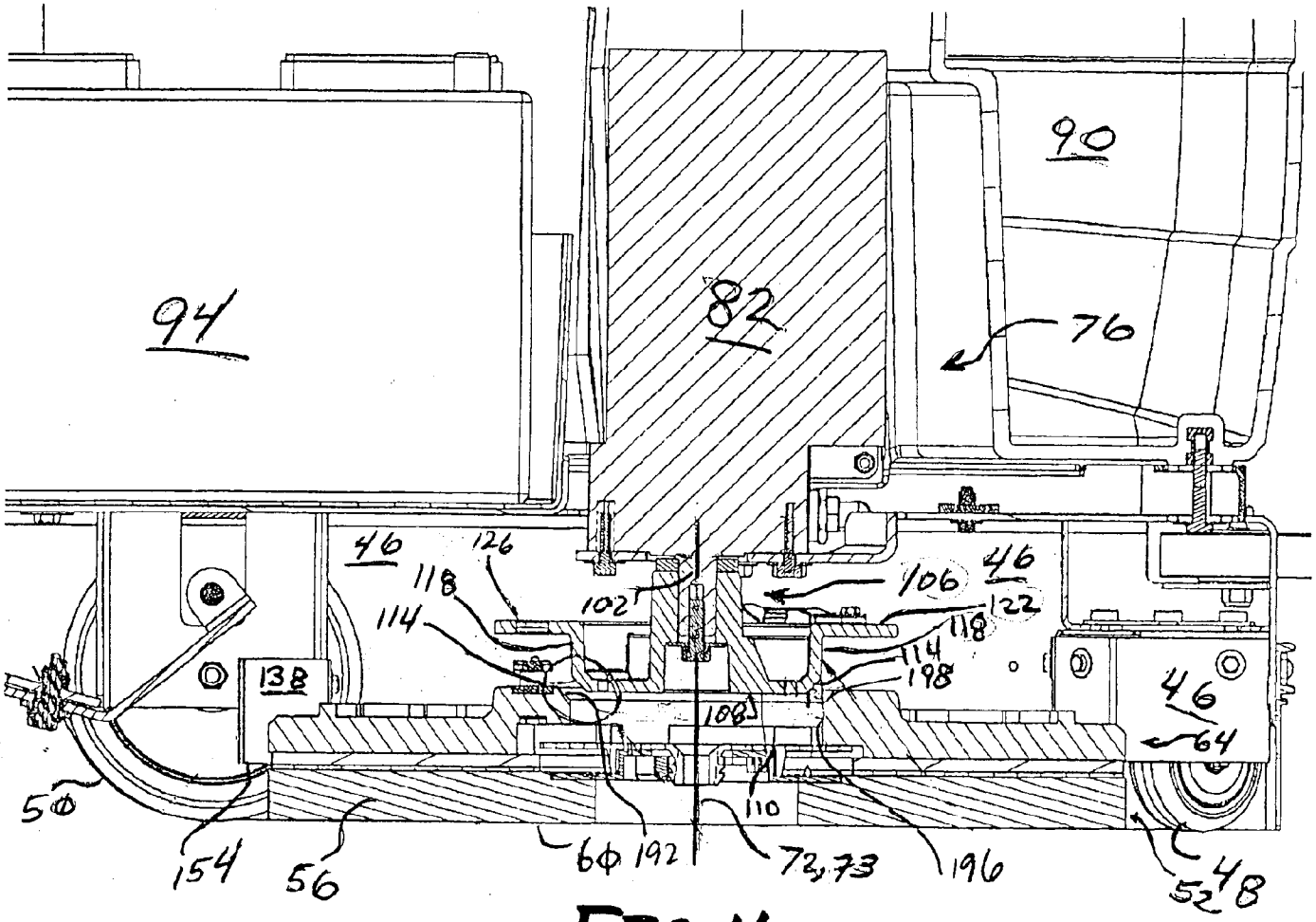
FIG. 4 shows a cross sectional view of the floor care machine 20. In particular, this cross sectional view is a view of the floor care machine 20 along the face of the cutting plane A viewed from the direction of arrow V, wherein the cutting plane A perpendicularly bisects the front 42 of the floor care machine.
Figure 8:
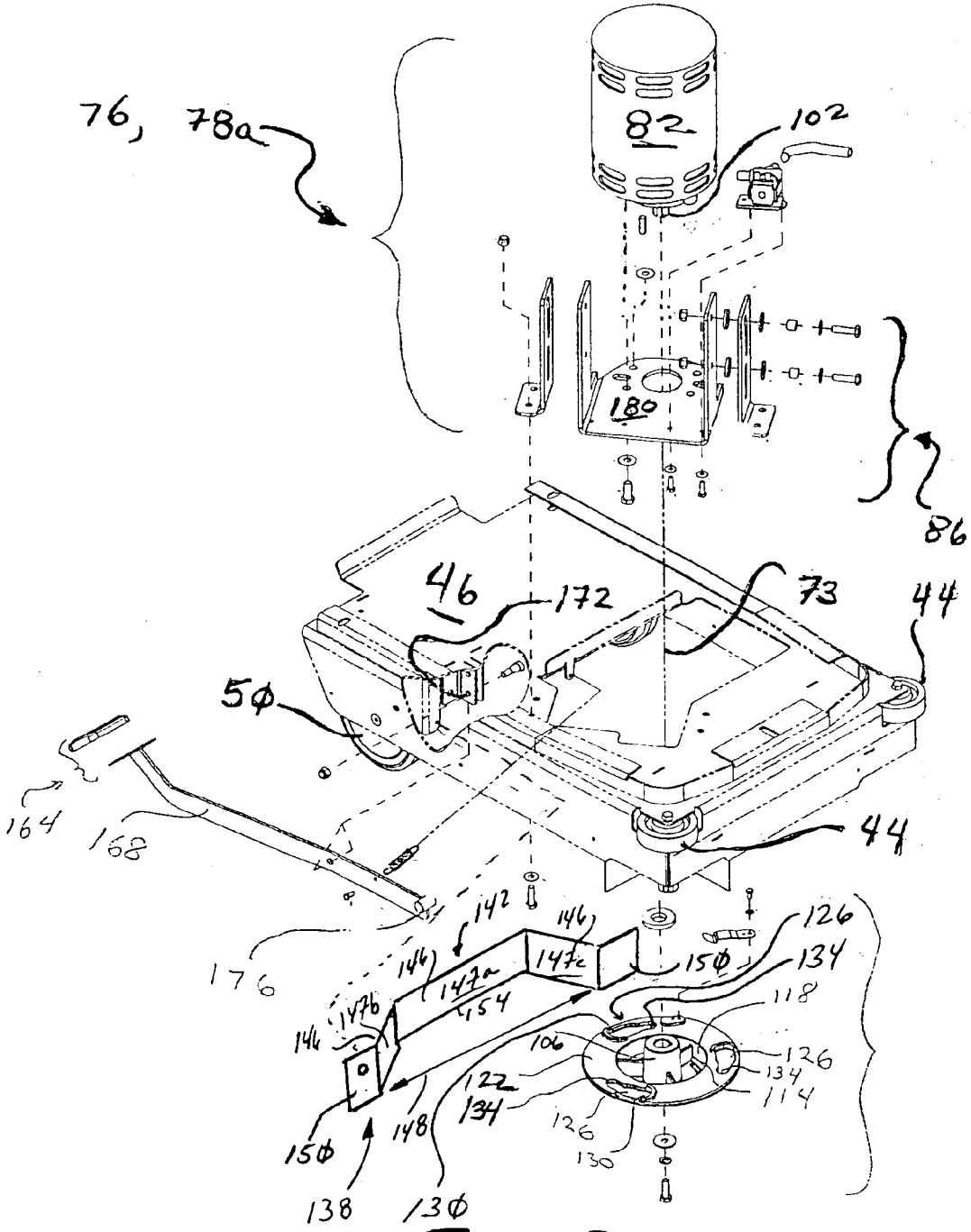
FIG. 8 is an exploded view of some of the internal components of the floor care machine 20.

Referring now principally to FIGS. 2, 4 and 8, the components will now be described for replaceably attaching the floor care element 52 to the machine 20. The lower drive assembly 78*b*, which is fixedly attached to the motor shaft 102 (FIG. 4) for rotating this assembly about central axis 72, includes a central hub 106 which fits about the shaft 102, and which also projects further downwardly wherein the hub terminates in a protuberance 108 having a surface 110 which blends into a chamfer 114 that circles the axis 72 of the motor shaft 102. The chamfer 114, in turn, is unitary with a substantially vertical annular wall 118 which extends upwardly from chamfer. From the annular wall 118 there is an annular attachment ring 122 which is also radially uniformly spaced from the vertical axis 72. The attachment ring 122 includes one or more slots 126 that are sized and shaped so that there are paired slot ends 130 and 134 (FIG. 8). Note that at slot end 130, the expanded head 71 of an attachment piece 68 can easily be extended through this slot end. However at slot end 134, which is not as wide as slot 130, the recess 70 is able to fit but the expanded head 71 is too large to fit therethrough. Accordingly, since the attachment pieces 68 and the slots 126 are, respectively, positioned on the attachment assembly 64 and on the ring 122 so that each of the pieces 68 is able to align with a slot 130 in a first configuration and align with the paired slot 134 in a second configuration, the attachment pieces 68 secure the floor care element 52 to the lower drive assembly 78*b* in the second configuration, and allow the floor care element 52 to be attached and/or released from the lower drive assembly 78*b* in the first configuration. Thus, since the motor 82 only rotates in direction 74 when the floor is being processed, and since this direction will urge attachment pieces 68 in the slots 126 toward the slot ends 134, a floor care element 52 attached to the lower drive assembly 78*b* will remain securely attached during floor care operations. However, if the rotation of the motor 82 is reversed, the attachment pieces 68 are able to move the slot ends 130, and accordingly disengage from the slots 126 when the lower drive assembly 78*b* is raised substantially vertically due to, e.g., the machine 20 being raised on its rear wheels 50 via a pivoting motion by an operator wherein the front wheels 48 are raised off the floor.

Figure 6:
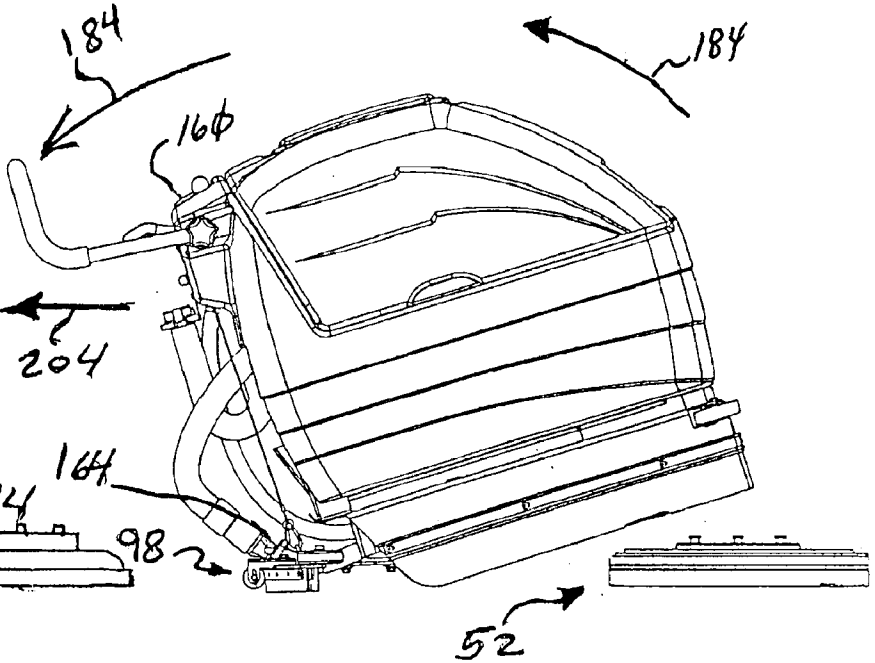
FIG. 6 is another side view of the floor care machine 20, wherein the machine 20 has been tilted counterclockwise on its rear wheels 50 so that the floor care element 52 can be captured underneath the machine 20.

In order to easily attach a floor care element 52 to the lower drive assembly 78*b*, these two components must be properly aligned with one another so that each of the attachment pieces 86 enter a corresponding one of the slots 126. Accordingly, the machine 20 includes an aligner 138 (FIGS. 2, 4 and 8) for aligning the floor care element 52 with the lower drive assembly 78*b*. In one embodiment of the invention (e.g., as shown in FIGS. 1–8), the aligner 138 includes an aligning portion 142 which is a series of plates 146 which are angularly attached to one another to form a polygonal shape that generally conforms to the curvature of the perimeter of the floor care element 52 when this element is on the floor as shown in FIGS. 2, 4, and 6. More particularly, the aligner portion 142 shown in FIG. 8 includes a center plate 146 with a substantially planar face 147*a* and on each end thereof, an attached plate 146 (i.e., a "wing plate") whose corresponding planar faces 147*b* and 147*c* are neither coplanar with the face 147*a* of the center plate nor with one another. Moreover, the distance 148 (FIG. 8) between the distal ends of the series of plates 146 is sufficiently wide so that there is substantially no likelihood that when the floor care element 52 is underneath the machine 20 that this element will not be properly positioned by the aligning portion 142. Accordingly, in at least one embodiment, the distance 148 is at least as large as the diameter of the floor care element 52. Additionally, as shown in FIG. 8, the aligner 138 includes opposing end plates 150 by which the aligner is joined to at least one of the main body 34 and the frame 46. In one embodiment, the aligner 138 is joined to the machine 20 so that the aligner contacts the rigid attachment assembly 64 during the process of aligning a floor care element 52 for engaging the lower drive assembly 78*b*. Additionally, the aligner member 138 will be nearly contacting an attached floor care element 52 when this element is engaged to the lower drive assembly 78*b*. For example, one or more of the surfaces 147*a*, 147*b* and 147*c* will be within one inch of a floor care element 52 attached to the machine 20, and more preferably within less than half an inch. Accordingly, the lower edge 154 (FIGS. 4 and 8) extends downwardly farther than does the drive assembly 76, at least when a floor care element 52 is attached to the drive assembly.

Thus, when a floor care element 52 is to be engaged with the lower drive assembly 78*b*, the floor care element is caused to align with the aligning portion 142 (e.g., the floor care element's perimeter contacts each of the plates 146) so that the axis 72 is substantially coincident with the central axis 73. Thus, the attaching member 66 can be easily caused to enter the slots 126 by either: (a) having the operator visually inspect and adjust the orientation of the attaching members and the slots so that the attaching members enter the slots, or, (b) having the operator activate the motor 84 for slowly rotating the slots 126 so that they align with the attaching members. In either case, once the operator determines that the attaching members 66 have entered the slots 126 (e.g., by the sound of the entry into slots, and/or by determining that the machine 20 is resting on both its front and back wheels 48 and 50), the operator can commence normal floor care operations according to, e.g., the embodiment of machine 20 being used, and according to the type of floor care element 52 attached to the machine 20.

Figure 5:
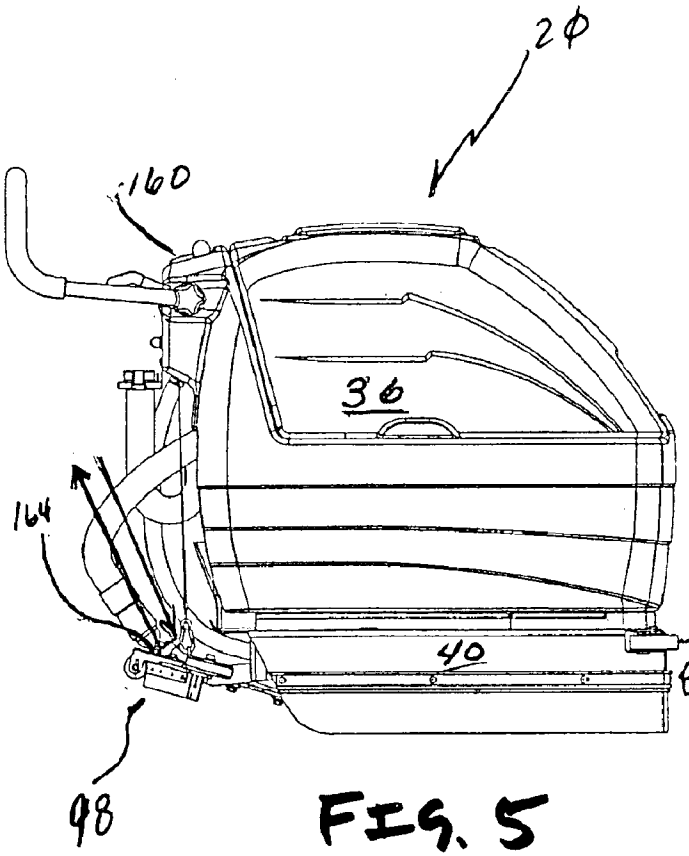
FIG. 5 is a side view of the floor care machine 20 with a floor care element 52 positioned in front of it in preparation for attaching the element 52 to the underside of the machine 20.
Figure 7:
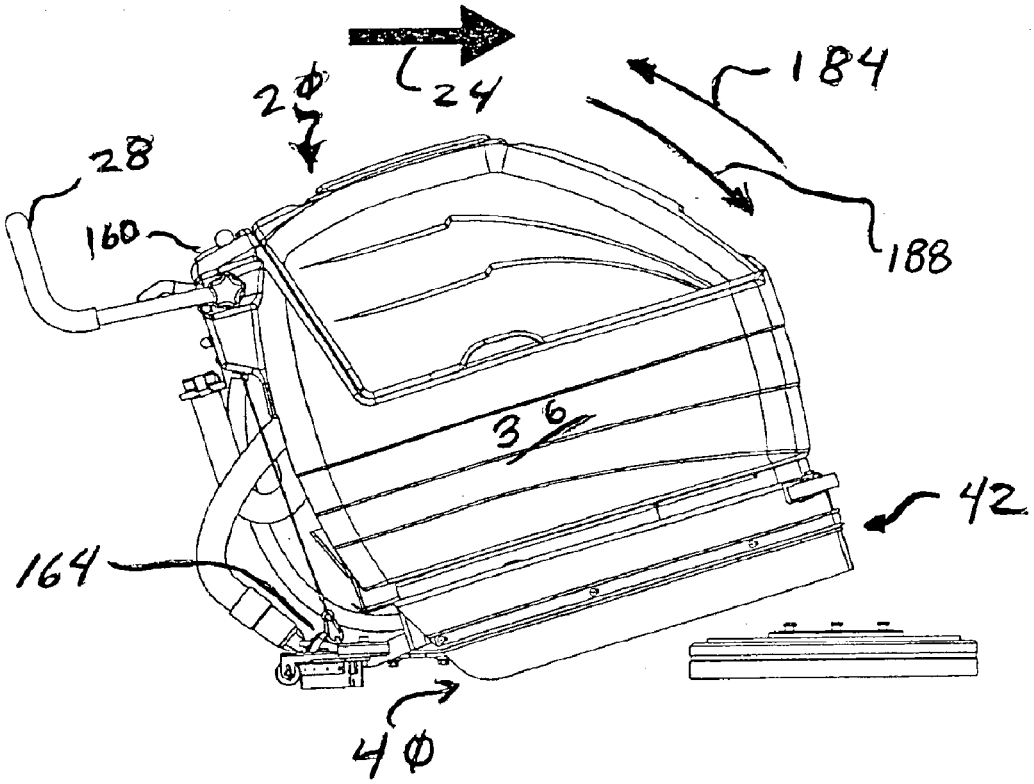
FIG. 7 is another side view of the floor care machine 20, wherein the machine 20 has been tilted counterclockwise on its rear wheels 50 so that a previously attached floor care element 52 can be removed from underneath the machine 20.

An example, of the steps by which an operator may attach a floor care element 52 to the machine 20 is illustrated in FIGS. 5 and 7. In a first step the operator positions the machine 20 laterally so that when the machine is further moved in the direction of arrow 24 (either manually or via a motorized drive train), the axes 72 and 73 will become substantially coincident when the machine 20 continues in the direction 24. FIG. 5 illustrates the resulting positioning of the machine 20 relative to the floor care element 52. Subsequently, the operator turns off the machine 20 by toggling the power control switch 160. Referring now to FIG. 7, the operator then steps down with his/her foot on the pivot pedal 164. Since this pedal is connected to bar 168 (FIG. 8), and the bar is pivotally attached to the frame 46 (at pivot point 172 substantially above, but preferably somewhat forward of the rear wheels 50), the distal bar end 176 pivots upwardly. In doing so, it pushes against the upper drive assembly 78*a* (and in particular, the motor attachment plate 180, FIG. 8) thereby causing first the drive assembly 76 to move upwardly. Once the limit of its upward movement independent of the rest of the machine 20 is reached, the front of the machine 20 also pivots upwardly in the direction of arrow 184 (FIG. 7) so that the front 42 can vertically clear the top of the processing/cleaning element 52. Thus, by the operator pressing on the pedal 164, the machine 20 can be easily moved forward (in the direction of arrow 24) on only its rear wheels 50 so that the floor care element 52 moves underneath the skirting 40. Accordingly, once the operator senses that the floor care element 52 has come into contact with the aligning portion 142 so that there is an increased resistance to any further machine 20 movement in all directions but in substantially the opposite direction of arrow 24, the floor care element's axis 72 will be approximately coincident with the central axis 73 (e.g., these axes will be within an inch of one another, and more preferably within half an inch). Note that for at least some embodiments of the machine 20, such aligning of these axes corresponds to the operator centering the floor care element 52 underneath the machine 20. Moreover, note that upon the floor care element 52 contacting the aligning portion 142, the floor care element 52 may be moved by the aligning portion 142 so that it more uniformly contacts the aligning portion and thus approximately aligns the axes 72 and 73. In particular, the operator may need to merely continue moving the machine 20 forward thereby pushing the floor care element 52 with the aligning portion 142 so that the element 52 both moves in the direction 24, as well as moves in other directions relative to the movement of the machine 20 until the floor care element is moving only in the direction 24.

Subsequently, the operator can then stop the movement of the machine 20, and reduce his/her foot pressure on the pedal 164 and thereby, firstly, allow the entire machine 20 to pivot downwardly in the direction of arrow 188, and secondly, once the machine is also resting on its front wheels 48, allow the drive assembly 76 to further lower onto the top of the floor care element 52. Moreover, since the axes 72 and 73 are approximately aligned, the chamfer 114 will be sufficiently aligned with the circular mating chamfer 192 (FIGS. 3 and 4) at the rim of the otherwise generally cylindrical bore 196. In particular, at least one of the mating chamfers has a lateral extent (e.g., one of which is labeled 198 in FIG. 4) that is at least the maximum distance that the axes 72 and 73 can be misaligned by the aligning portion 142. Thus, when these two mating chamfers contact one another for further aligning the axes 72 and 73, the protuberance 108 slides into the bore 196. Accordingly, the mating chamfers may be considered as part of an "aligning device" for aligning the axes 72 and 73. Moreover, it is within the scope of the invention that only the mating chamfers may be used for aligning these axes, or alternatively that only the aligner 138 may be used for aligning the axes. If only such mating chamfers are used for aligning, then such lateral distances 198 will preferably be greater, e.g., 2 to 3 inches. If only the aligner 138 is used for aligning (or where the chamfers are, e.g., very small such as ¼ inch), then in one embodiment the aligner can be able to be shifted between a forward position for substantially precisely aligning the axes 72 and 73, and shifted rearward away from the perimeter of an attached floor care element 52 so that there is no contact therebetween when performing floor care operations on the floor.

Thus, if the operator has previously oriented the attaching members 66 with the slots 126 so that they are generally in the same angular positions about their axes 72 and 73, then the mating members will enter the slots. However, if the attaching members 66 and the slots 126 are somewhat misaligned (whether or not the operator has attempted to manually orient them about their axes), the operator may activate the motor 84 and allow it to slowly rotate the lower drive assembly 78*b,* and in particular, the slots 126 until the attaching members 66 enter the slot ends 130. Subsequently, upon sensing that the attaching members 66 have entered the slots (e.g., by the sound of such entering), the operator can then further secure the members 66 in the slots 126 by activating the motor 84 sufficiently to commence rotation of the floor care element 52 thereby causing each of the attaching members to move to it corresponding slot end 134.

Note if the machine 20 already has a floor care element 52 attached thereto, then such an element must be detached prior to attaching a different one according to the steps discussed above. For detaching a currently attached floor care element 52, the operator halts the forward movement of the machine 20 (either manually, or by one or more of the controls 32 for activating a brake and/or governing the transmittal of power to the rear wheels 50 via a motorized drive train), then the operator deactivates the motor 84 (via power control switch 160). The operator subsequently reverses the direction of motor 84 rotation (via motor rotation controller 200, e.g., FIG. 1). Then the operator activates the motor for a short duration. Accordingly, the motor 84 rotates in the opposite direction to that of direction 74 (FIG. 3) thereby causing the attaching members 66 to slide to the slot end 130 of their respective slots 126. The operator determines that the attaching members 66 are at the slot end 130 due to distinct sounds made when the attaching members contact their respective slot ends 130. Afterwards, referring to FIG. 6, the operator can deactivate the motor 84, then press downward with his/her foot on the pedal 164 so that the drive assembly 76 moves vertically upward within the upper housing 36 until the limit of the motor's upward movement independent of the rest of the machine 20 is reached. Accordingly, the floor care element 52 disengages from the lower drive assembly 78*b* upon lifting of the drive assembly 76. Moreover, the operator will sense such disengagement since otherwise a greater force is required from the operator to lift both the motor 84 and the floor care element 52 when he/she initially presses on the pedal 164. Subsequently, upon further pressing of the pedal 164, the front of the machine 20 pivots upwardly in the direction of arrow 184 so that the front of the machine is lifted substantially vertically. Assuming the floor care element 52 fully disengages from the lower drive assembly 78*b,* the configuration of FIG. 6 is attained wherein the floor care element 52 remains on the floor underneath the machine 20 while the front of the machine raised off the floor. Thus, the operator can then move the machine 20 in the reverse direction (i.e., along arrow 204) until the floor care element is laterally (e.g., horizontally) spaced apart from the machine 20. The operator can then allow the front of the machine 20 to pivot clockwise in the reverse direction to arrow 184 until the front wheels 48 rest on the floor. Accordingly, if desired the operator may perform the procedure described hereinabove to attach a different floor care element 52 to the machine 20.

The foregoing discussion of the invention has been presented for purposes of illustration and description. Further, the description is not intended to limit the invention to the form disclosed herein. Consequently, variation and modification commensurate with the above teachings, within the skill and knowledge of the relevant art, are within the scope of the present invention. The embodiment described hereinabove is further intended to explain the best mode presently known of practicing the invention and to enable others skilled in the art to utilize the invention as such, or in other embodiments, and with the various modifications required by their particular application or uses of the invention.

What is claimed is:

1. A method for replacing a floor element of a floor machine having a frame, a drive assembly, and a main body including a skirting that is located at the bottom of said main body, comprising:

locating a floor element including an attachment assembly for connecting said floor element to said floor machine in a desired location;

positioning said floor machine in at least one of a substantially lateral direction and a substantially vertical direction relative to said floor element;

using an aligner to align said floor element and said floor machine, said aligner being different from said frame, said drive assembly and said main body including said skirting and being different from said floor element including said attachment assembly, said aligner being joined to said at least one of said frame and said main body and being located inwardly of said skirting and outwardly of said drive assembly; and joining said floor element to said floor machine.

2. The method, as claimed in claim 1, wherein:

said using includes contacting at least aligning portions of said aligner by at least portions of said floor element.

3. The method, as claimed in claim 2, wherein:

said contacting includes causing said floor element to move relative to said aligner.

4. The method, as claimed in claim 2, wherein:

said joining includes stopping movement of said floor machine in said horizontal direction after said contacting.

5. The method, as claimed in claim 1, wherein:

said locating includes locating said floor element on a floor surface and spaced from said floor machine.

6. The method, as claimed in claim 1, wherein:

said positioning includes moving said floor machine in said substantially lateral direction along a floor surface.

7. The method, as claimed in claim 6, wherein:

said positioning includes raising at least portions of said floor machine in said substantially vertical direction.

8. The method, as claimed in claim 1, wherein:

said positioning includes substantially centering said floor machine relative to said floor element.

9. The method, as claimed in claim 1, wherein:

said joining includes moving at least portions of said floor machine in said substantially vertical direction downwardly towards a floor surface on which said floor element is located.

10. The method, as claimed in claim 1, wherein:

said joining includes contacting a chamfer of said floor element.

11. The method, as claimed in claim 1, wherein:

said joining includes activating a motor of a drive assembly of said floor machine to engage said floor element.

12. The method, as claimed in claim 1, further including:

disengaging a previous floor element at least before said positioning.

13. The method, as claimed in claim 1, further including:

activating a motor associated with a drive assembly of said floor machine to release a previous floor element and then changing position of said floor machine to expose said previous floor element.

14. The method, as claimed in claim 1, wherein during said using, at least a portion of said aligner contacts said attachment assembly.

15. The method, as claimed in claim 1, wherein said aligner includes a number of plates that generally conform to at least portions of said floor element.

16. The method, as claimed in claim 15, wherein a distance is defined between portions of said plates having sufficient width such that said floor care element is properly positioned using said aligner.

17. The method, as claimed in claim 1, wherein said positioning includes canting said floor machine such that a substantially unobstructed path is provided between said floor element and said aligner, and wherein contact between said floor element and said aligner is initiated by rolling said floor machine towards said floor element until contact between said floor element and said aligner.

* * * * *